US008917213B2

(12) United States Patent
Aizawa et al.

(10) Patent No.: US 8,917,213 B2
(45) Date of Patent: Dec. 23, 2014

(54) ANTENNA DEVICE AND ELECTRONIC TIMEPIECE

(75) Inventors: Tadashi Aizawa, Suwa (JP); Teruhiko Fujisawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 176 days.

(21) Appl. No.: 13/402,679

(22) Filed: Feb. 22, 2012

(65) Prior Publication Data

US 2012/0213039 A1 Aug. 23, 2012

(30) Foreign Application Priority Data

Feb. 23, 2011 (JP) ..... 2011-036807
Aug. 23, 2011 (JP) ..... 2011-181280

(51) Int. Cl.

| | |
|---|---|
| ***H01Q 1/12*** | (2006.01) |
| ***G04R 60/12*** | (2013.01) |
| ***G04R 20/04*** | (2013.01) |
| ***H01Q 9/04*** | (2006.01) |
| ***H01Q 1/27*** | (2006.01) |

(52) U.S. Cl.

CPC ..... *G04R 20/04* (2013.01); *G04R 60/12* (2013.01); *H01Q 9/0428* (2013.01); *H01Q 9/0407* (2013.01); *H01Q 1/273* (2013.01)

USPC ..... 343/718; 343/702

(58) Field of Classification Search

CPC ..... H01Q 1/273; H01Q 9/0407
USPC ..... 343/718, 702; 368/10, 88, 47; 349/96
See application file for complete search history.

(56) References Cited

U.S. PATENT DOCUMENTS

| | | | | |
|---|---|---|---|---|
| 3,712,047 | A * | 1/1973 | Girard | 368/242 |
| 4,026,637 | A * | 5/1977 | Yamazaki | 349/96 |
| 5,367,502 | A * | 11/1994 | Barroso et al. | 368/10 |
| 6,937,301 | B2 * | 8/2005 | Sekiguchi et al. | 349/96 |
| 7,417,596 | B2 * | 8/2008 | Zellweger et al. | 343/718 |
| 8,467,272 | B2 * | 6/2013 | Fujisawa | 368/47 |

FOREIGN PATENT DOCUMENTS

| | | | |
|---|---|---|---|
| JP | 10-197662 | A | 7/1998 |
| JP | 2003-066169 | A | 3/2003 |
| JP | 2007-124011 | A | 5/2007 |

* cited by examiner

*Primary Examiner* — Hoang V Nguyen
(74) *Attorney, Agent, or Firm* — Kilpatrick Townsend & Stockton LLP

(57) ABSTRACT

An antenna device which is provided in an electronic timepiece, and receives positioning signals from satellites includes: a first electrode; a second electrode; and a dielectric layer arranged between the first electrode and the second electrode, wherein one electrode of the first electrode and the second electrode constitutes at least a part of a character plate of the electronic timepiece.

10 Claims, 11 Drawing Sheets

ANTENNA DEVICE AND ELECTRONIC TIMEPIECE

This application claims priority to Japanese Patent Application No. 2011-036807, filed Feb. 23, 2011 and Japanese Patent Application No. 2011-181280, filed Aug. 23, 2011, the entirety of which are hereby incorporated by reference.

BACKGROUND

1. Technical Field

The present invention relates to an antenna device capable of achieving reduction in size and an electronic timepiece including the antenna device.

2. Related Art

In the related art, for an antenna device which can be provided in an electronic timepiece, a configuration in which an antenna is provided to be bonded to a display plate (character plate) of an electronic timepiece is disclosed. With this configuration, the antenna is provided on the rear side of the display plate, that is, on a non-visible side, thereby avoiding the design appearance of the electronic timepiece from being damaged due to the antenna. The electronic timepiece can have a noncontact data communication function while substantially maintaining the appearance in the related art (see JP-A-2003-66169).

As an example, an antenna device is known which has a plurality of (two) chip-like elements. With this antenna device, it is possible to receive circularly polarized waves, such as GPS (Global Positioning System) electric waves. The elements of the antenna device can be used as dials of a character plate for an electronic timepiece. The antenna device can have a function as a part of design elements of the electronic timepiece, in addition to a function as an antenna (for example, JP-A-2007-124011).

In the related art, these antenna devices are provided in electronic timepieces in which the antenna devices are difficult to be mounted due to the restriction of design, size, and the like. This contributes to the functional extension of an analog electronic timepiece.

As another example, a receiver (antenna device) in an electronic timepiece in which a planar receiving antenna functioning as an electric wave receiving terminal and a timepiece unit having a digital display unit are arranged in an overlapping manner. In the example of the receiver, while the planar receiving antenna and the timepiece unit do not simply overlap each other, a cover glass of the timepiece unit is used as an antenna dielectric of the planar receiving antenna, and a conductive thin film is provided in the cover glass. With this configuration, it becomes possible to achieve a reduction in the size of the receiver (for example, JP-A-10-197662).

However, according to the technique of JP-A-2003-66169, in order to increase communication sensitivity, there is the restriction that a material for a region of the display plate where the antenna is attached should be an insulating member, not a conductive member, and there is a problem from the viewpoint of selection of the material of the display plate, surface treatment relating to design, or the like. According to the technique of JP-A-2007-124011, there are problems in that a plurality of elements should be arranged such that the reception characteristic directions cross each other, it is necessary to provide phase changing means for changing the phase of a received signal so as to show a phase difference based on the crossing angle of the reception characteristic directions, and complicated control should be performed. According to the technique of JP-A-10-197662, since the cover glass is used as the antenna dielectric, feed terminals for feeding power to a conductive thin film and the conductive thin film are provided on the front surface of the cover glass, that is, on the side where the time is visible, and there is the restriction that it is necessary to take into consideration the arrangement such that visual recognition of the time or the like is not obstructed, friction resistance, corrosion resistance, and the like.

SUMMARY

An advantage of some aspects of the invention is to solve at least a part of the problems described above, and the invention can be implemented as the following forms or application examples.

APPLICATION EXAMPLE 1

This application example is directed to an antenna device which is provided in an electronic timepiece, and receives positioning signals from satellites. The antenna device includes a first electrode, a second electrode, and a dielectric layer arranged between the first electrode and the second electrode. The first electrode constitutes at least a part of a character plate of the electronic timepiece.

According to this antenna device, the antenna device has the first electrode, the dielectric layer, and the second electrode, and receives positioning signals from satellites with this configuration. In regard to positioning signals from satellites, circularly polarized waves are used so as to be receivable even by an antenna device being moved. In the case of the circularly polarized waves, the electric field direction rotates over time. Thus, in order to receive circularly polarized waves, a current which rotates over time, that is, an orthogonal current may flow in the first electrode or the second electrode, such that an excitation mode which is excitation with a phase difference is generated. The antenna device has a configuration which is excellent in receiving the circularly polarized waves, and if power is fed, the electrode which receives the circularly polarized waves are excited in two excitation modes with an orthogonal phase difference to receive the circularly polarized waves. The antenna device having this function can be optimally incorporated in the electronic timepiece as a small electronic apparatus. In this case, the first electrode constitutes at least a part of the character plate of the electronic timepiece, making it possible to minimize the occupying region of the antenna device in the electronic timepiece. The character plate is constituted as an electrode to receive electric waves, thus it is not necessary that, unlike the related art, the character plate is formed of an insulating member or the like so as to avoid electric wave absorption, and it is not necessary to provide electric control for changing the phase of a received signal of electric waves, or the like. Therefore, the antenna device can exhibit a function of receiving electric waves in an analog electronic timepiece without restricting the design or the like of the incorporated electronic timepiece.

APPLICATION EXAMPLE 2

In the antenna device according to the above application example, it is preferable that the character plate has the first electrode and a time display portion which is formed on the surface of the electrical conductor portion.

With this configuration, the first electrode constituting at least a part of the character plate in the antenna device is the electrical conductor portion which is formed of an electrical conductor material such that a function of receiving a positioning signal is exhibited when power is fed. Examples of the material for the electrical conductor portion include copper, aluminum, iron, gold, silver, or an alloy thereof. On the surface of the electrical conductor portion, the time display portion which displays the time indicated by the hour hand and the minute hand is formed. In this way, in the case of the character plate with the electrical conductor portion as a base material, the installation space is saved, and it is not necessary to take into consideration special design, such as rearrangement of other timepiece components, compared to the related art in which an antenna device is newly and separately provided in an electronic timepiece.

APPLICATION EXAMPLE 3

In the antenna device according to the above application example, it is preferable that the time display portion is an electrical nonconductor.

With this configuration, since the time display portion which is formed for visual recognition of the time of the electronic timepiece has the characteristics of an electrical, nonconductor, it is possible to avoid a situation in which circularly polarized waves which will reach the electrical conductor portion are attenuated by the time display portion. That is, the antenna device can maintain an excellent reception performance while functioning as a character plate.

APPLICATION EXAMPLE 4

In the antenna device according to the above application example, it is preferable that the second electrode constitutes at least a part of a mechanical body of the electronic timepiece.

With this configuration, in the antenna device, the first electrode functions as a character plate and the second electrode constitutes at least a part of the mechanical body. That is, another electrode is also used as the mechanical body, such that it is not necessary to newly arrange another electrode in the electronic timepiece. Therefore, even when the antenna device is incorporated, it is possible to further suppress an increase in the size, particularly, the thickness of the electronic timepiece.

APPLICATION EXAMPLE 5

This application example of the invention is directed to an antenna device which is provided in an electronic timepiece, and receives positioning signals from satellites. The antenna device includes an antenna unit which has a first electrode, a second electrode, and a dielectric layer arranged between the first electrode and the second electrode, and a reflective liquid crystal display unit which has a light reflective portion and a liquid crystal panel portion displaying information. The first electrode constitutes at least a part of the light reflective portion of the reflective liquid crystal display unit.

According to this antenna device, the antenna device has the antenna unit and the reflective liquid crystal display unit corresponding to a character plate in an analog electronic timepiece. The antenna unit has a configuration in which the first electrode faces the second electrode through the dielectric layer. The reflective liquid crystal display unit has the liquid crystal panel portion and the light reflective portion which reflects light transmitted the liquid crystal panel portion and transmits light through the liquid crystal panel portion again. In this antenna device, since the first electrode of the antenna unit constitutes at least a part of the light reflective portion, unlike the related art, it is not necessary to take into consideration the arrangement of the electrode (conductive thin film) such that visual recognition of the time or the like is not obstructed, friction resistance, corrosion resistance, or the like. Therefore, it is possible to reduce the number of constituent elements of the antenna device while receiving electric waves, thereby achieving a reduction in the size of the electronic timepiece.

APPLICATION EXAMPLE 6

This application example of the invention is directed to an antenna device which is provided in an electronic timepiece, and receives positioning signals from satellites. The antenna device includes an antenna unit which has a first electrode, a second electrode, and a dielectric layer arranged between the first electrode and the second electrode, a transmissive liquid crystal display unit which has a liquid crystal panel portion for displaying information, and an organic electroluminescence unit which is a light source of the transmissive liquid crystal display unit, and has a light-emitting layer and a light source electrode for emitting light from the light-emitting layer. The first electrode constitutes at least a part of the light source electrode of the organic electroluminescence unit.

According to this antenna device, the antenna device has the antenna unit and the transmissive liquid crystal display unit corresponding to a character plate of an analog electronic timepiece. The antenna unit has a configuration in which the first electrode faces the second electrode through the dielectric layer. The transmissive liquid crystal display unit has the liquid crystal panel portion and the light source portion which emits light as a light source of the liquid crystal panel portion. In this antenna device, since the first electrode of the antenna unit constitutes at least one of the light source portion, unlike the related art, it is not necessary to take into consideration the arrangement of the electrode (conductive thin film) such that visual recognition of the time or the like is not obstructed, friction resistance, corrosion resistance, or the like. Therefore, it is possible to reduce the number of constituent elements of the antenna device while receiving electric waves, thereby achieving a reduction in the size of the electronic timepiece.

APPLICATION EXAMPLE 7

This application example of the invention is directed to an electronic timepiece including the above-described antenna device.

According to this electronic timepiece, the first electrode constitutes a character plate of an analog electronic timepiece, the light reflective portion of the reflective liquid crystal display unit which achieves a character plate function, or the light source electrode of the transmissive liquid crystal display unit which achieves a character plate function, making it possible to minimize the occupying region of the antenna device. Therefore, even when the antenna device is incorporated, the electronic timepiece can sufficiently achieve the function of receiving electric waves without being subjected to the restriction of design or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an antenna device according to an embodiment of the invention and an electronic timepiece including the antenna device will be described with reference to the accompanying drawings.

Embodiment 1

First, as an example of a communication system which receives positioning signals from satellites and uses the positioning signals, a GPS system will be introduced, and the outline thereof will be described. As a communication system using satellites, in addition to a GPS system, there are WAAS (Wide Area Augmentation System), QZSS (Quasi Zenith Satellite System), GLONASS (GLObal NAvigation Satellite System), GALILEO, and the like. These systems may be used.

Figure 1:
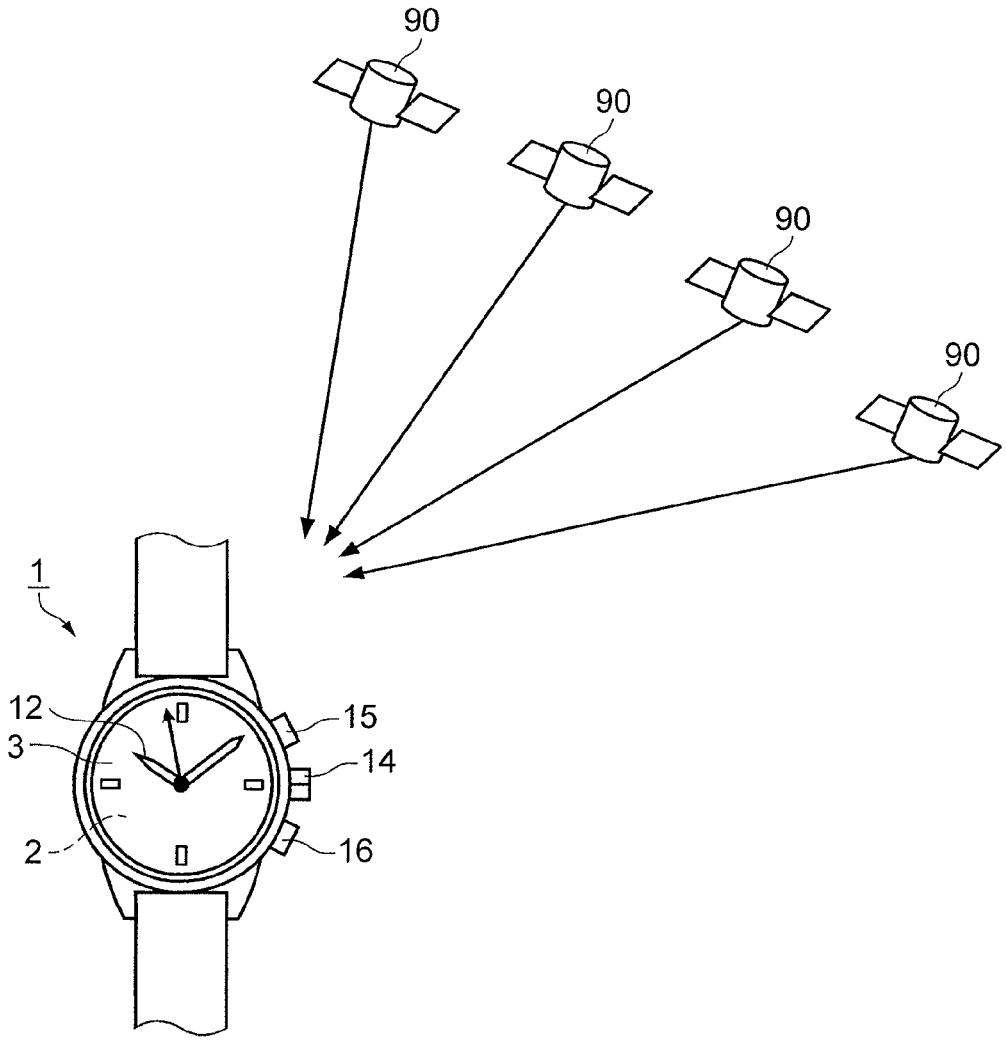
FIG. 1 is a schematic view showing the outline of a GPS system in Embodiment 1.

FIG. 1 is a schematic view showing the outline of a GPS system in Embodiment 1. As shown in FIG. 1, GPS satellites (satellites) 90 travel in a predetermined orbit above the earth, and transmit satellite signals, in which a navigation message or the like is superimposed on a microwave of 1.57542 GHz, to the ground. Each GPS satellite 90 has an atomic timepiece mounted therein, and the satellite signal includes GPS time information which is very accurate time information measured by the atomic timepiece. For this reason, a wristwatch (electronic timepiece) 1 having a function as a GPS receiver receives the satellite signals, and corrects the advance or delay of the internal time to display accurate time. This correction is done as a time measurement mode.

The satellite signal also includes orbit information which represents the position of the GPS satellite 90 in the orbit. That is, the wristwatch 1 can perform positioning calculation. Usually, the wristwatch 1 usually receives satellite signals transmitted from four or more GPS satellites and performs positioning calculation using orbit information and GPS time information in the satellite signals. With the positioning calculation, the wristwatch 1 can easily correct the time difference in accordance with the current position. This correction is done as a positioning mode. If the satellite signals are used, various applications for current position display, moving distance measurement, moving speed measurement can be made. An example will be described in which the wristwatch 1 has a function of correcting the time and the time difference in the time measurement mode and the positioning mode.

Figure 2:
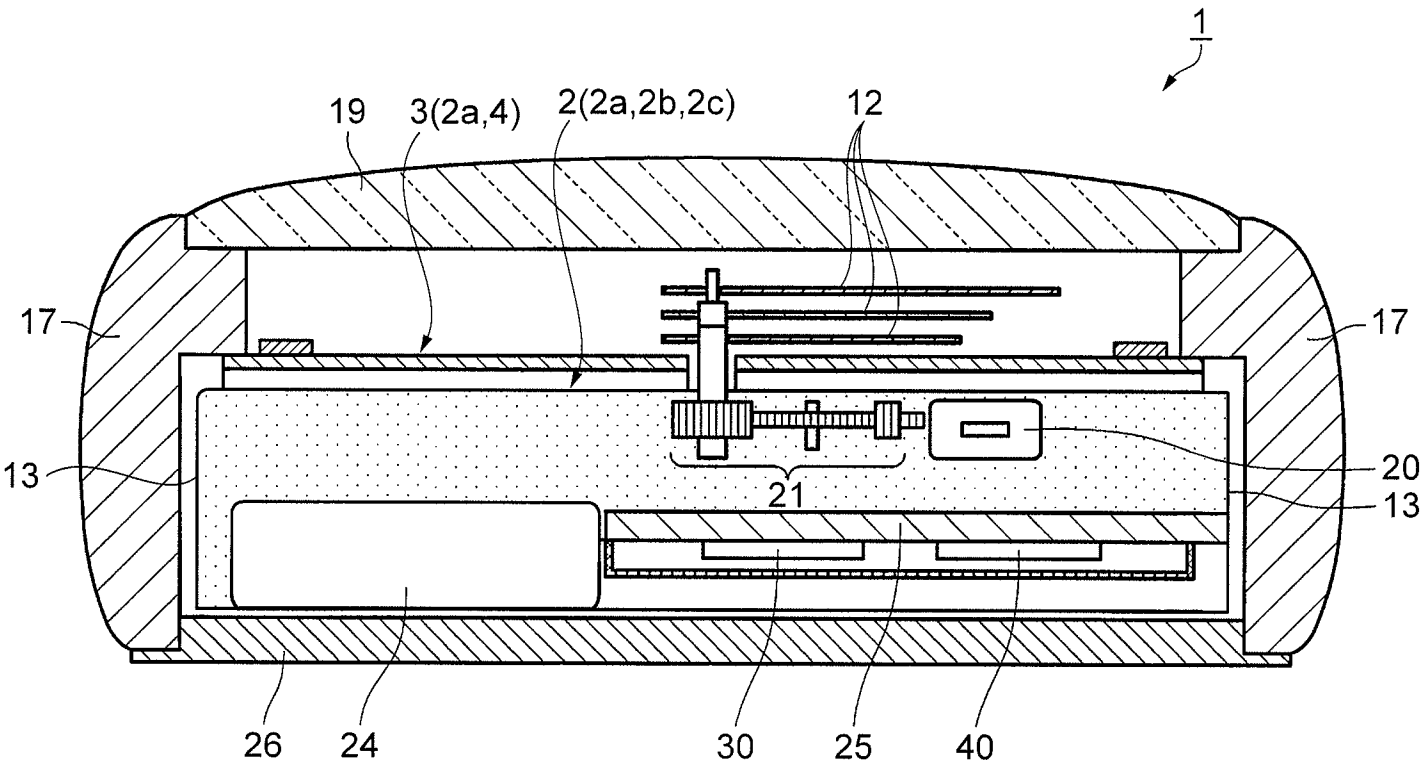
FIG. 2 is a sectional view showing the configuration of an analog wristwatch having a GPS reception function in Embodiment 1.

An example of the configuration of the wristwatch 1 having a GPS reception function will be described. FIG. 2 is a sectional view showing the configuration of a wristwatch having a GPS reception function in Embodiment 1. As shown in FIGS. 2 and 1, the wristwatch 1 with a GPS reception function includes an exterior case 17 which is made of metal, such as stainless steel or titanium, or resin, such as plastic. In this case, the exterior case 17 is formed in a substantially cylindrical shape. In the exterior case 17, a glass 19 is attached to an opening on the front side, that is, the side on which the time is visually recognized, and a rear cover 26 is attached to an opening on the rear side. Inside the exterior case 17 are arranged a movement (mechanical body) 13 which is a mechanism for ticking, an antenna device 2 which is provided on the front side of the movement 13 and receives satellite signals, a character plate 3 which is provided on the front side of the antenna device 2 and in which time display for displaying the time in an analog manner is formed, an indicator 12 which indicates the time display of the character plate 3, a battery 24 which is embedded in the movement 13, and the like. Although in this case, the battery 24 is a button-type primary battery, a secondary battery, such as a solar cell, which is chargeable through photovoltaic power generation may be used.

The movement 13 includes a step motor 20 which is constituted by a motor coil, a stator, a rotor, and the like, and a train wheel 21 which transfers the driving of the step motor 20 to the indicator 12. A circuit board 25 is arranged on the rear cover 26 side of the movement 13. The circuit board 25 has a reception module 30 and a control unit 40 which will be described below with reference to FIG. 5. The circuit board is connected to the antenna device 2 or the battery 24 through a connector. That is, the reception module 30 or the control unit 40 is driven with power supplied from the battery 24. Power is also applied from the battery 24 to the antenna device 2 through a power feed unit 70 (FIG. 5) of the reception module so as to receive satellite signals.

The wristwatch 1 has a winding crown 14 or a button A15 and a button B16 on the 3 o'clock side of the exterior case 17. The button A15 and the button B16 are manually operated to set the time measurement mode and the positioning mode. For example, if the button A15 is depressed, the wristwatch 1 is in the time measurement mode in which the advance or delay of the time is corrected. If the button B16 is depressed, the wristwatch 1 is in the positioning mode in which the time difference is corrected. The wristwatch 1 may be set so as to execute the time measurement mode or the positioning mode regularly and automatically.

Figure 3:
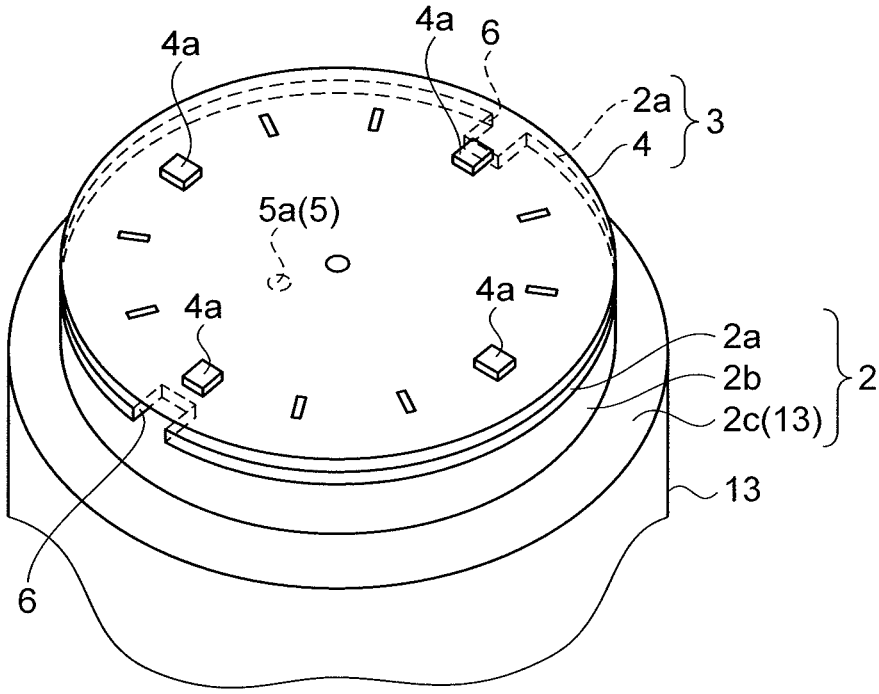
FIG. 3 is a perspective view showing the configuration of a character plate and an antenna device of a wristwatch.
Figure 4A:
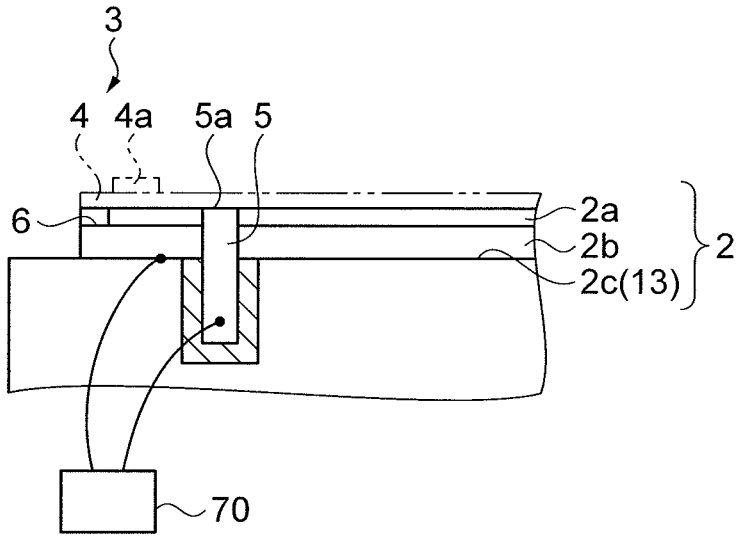
FIG. 4A is a sectional view showing the detailed configuration of an antenna device.
Figure 4B:
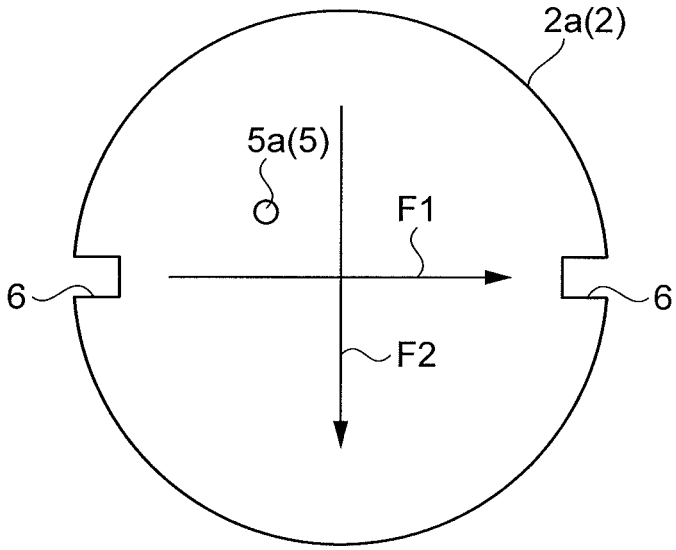
FIG. 4B is a plan view showing an excitation mode in a patch metal plate.

Next, the detailed configuration of the antenna device 2 and the character plate 3 which are arranged between the movement 13 and the indicator 12 in the wristwatch 1 will be described. FIG. 3 is a perspective view showing the configuration of a character plate and an antenna device of a wristwatch. FIG. 4A is a sectional view showing the detailed configuration of an antenna device, and FIG. 4B is a plan view showing an excitation mode in a patch metal plate.

The antenna device 2 which is embedded in the wristwatch 1 needs to receive the satellite signals from a plurality of GPS satellites 90. Since the electric waves of the satellite signals transmitted from the GPS satellites 90 are so-called circularly polarized waves, it is preferable that the antenna device 2 is a patch antenna which is suitable for receiving the circularly polarized waves, and has a compact shape so as to be incorporated in the wristwatch. Accordingly, the antenna device 2 is a patch antenna which constitutes a part of the character plate 3 of the wristwatch 1 and is combined with the character plate 3 as a single body.

As shown in FIGS. 3 and 4A, the antenna device 2 has a patch metal plate 2*a* which is an electrical conductor portion and serves as a first electrode, a movement electrode portion 2*c* which is a character plate receiving surface of the movement 13 and has a function as a second electrode, and a dielectric layer 2*b* which is arranged between the patch metal plate 2*a* and the movement electrode portion 2*c*.

The patch metal plate 2*a* is made of a conductor, such as copper, aluminum, iron, gold, silver, or a palladium, or an alloy thereof. In this case, the patch metal plate 2*a* is formed in a circular shape using brass, that is, a copper alloy. The patch metal plate 2*a* has cut portions 6 which are formed with a predetermined cut amount from the outer circumference to the circle center so as to more effectively receive the circularly polarized waves. In this case, two cut portions 6 are formed in a rectangular shape to face each other on a virtual line passing through the circle center. The action of the cut portions 6 will be described with reference to FIG. 4B.

On the front side of the patch metal plate 2*a*, a time display portion 4 which displays the time is formed. The time display portion 4 is formed of plastic coating which is an electrical nonconductor, and has protrusion-like time display portions 4*a* at the positions of 12 o'clock, 3 o'clock, 6 o'clock, and 9 o'clock. That is, the patch metal plate 2*a* of the antenna device 2 constitutes the character plate 3 of the wristwatch 1 along with the time display portions 4 formed in the patch metal plate 2*a*.

The dielectric layer 2*b* has a circular shape of the substantially same size of the patch metal plate 2*a*, and examples of a usable material include alumina ($Al_2O_3$), mullite ($3Al_2O_3.2SiO_2$), steatite ($MgO/SiO_2$), forsterite ($2Mg_2O/SiO_2$) zirconia (PSZ), magnesia titanate ($MgTiCO_3$), and the like. In regard to the characteristics of the dielectric layer 2*b*, it is preferable that a dielectric constant is equal to or greater than 18 and equal to or smaller than 30, and a dielectric tangent is equal to or smaller than 0.001. Accordingly, in order to obtain these characteristics, it is preferable that, when the dielectric layer 2*b* in the electronic timepiece has a circular shape, the diameter is 2.5 cm to 3.5 cm, and when the dielectric layer 2*b* has a rectangular shape, the length of each side is 2 cm to 4 cm. In both cases, it is preferable that the thickness is 0.05 mm to 1.5 mm. In the wristwatch 1 which is an electronic timepiece, the dielectric layer 2*b* of the antenna device 2 uses magnesia titanate ($MgTiCO_3$) having a diameter of 3 cm and a thickness of 0.5 mm and has characteristics that a dielectric constant is 17 and a dielectric tangent is 0.001.

In the antenna device 2 having the above-described configuration, a power feed body 5 is provided so as to supply power from the power feed unit 70 to the antenna device 2. The power feed body 5 is provided at a predetermined position with respect to the patch metal plate 2*a*, that is, at a power feed point 5. The power feed body 5 is a metallic electrical conductor, and is mounted in the movement 13 such that the power feed body 5 is inserted into the dielectric layer 2*b* in a state of being connected to the patch metal plate 2*a*, and the inserted tip is not in contact with the movement 13 (the movement electrode portion 2*c*) through an insulator. Power is supplied from the power feed unit 70 to the patch metal plate 2*a* mounted in the movement 13 through the power feed body 5, and power is also supplied from the power feed unit 70 to the movement electrode portion 2*c*. In this case, the movement electrode portion 2*c* is on the ground side and functions as a so-called ground electrode.

Next, the reception of electric waves, that is, the positioning signals from the GPS satellites 90 by the antenna device 2 will be described. In regard to the electric waves from the GPS satellites 90, circularly polarized waves are used such that, even when a receiving object, such as a mobile object, is in an arbitrary direction, the receiving object can receive the electric waves. The circularly polarized waves have a form such that the electric field direction rotates over time. In general, a current flows in the same direction as the electric field direction of electric waves, thereby receiving the electric waves. Accordingly, in order to receive the circularly polarized waves, it is important to rotate a current flowing in the antenna over time. In order to rotate the current flowing in the antenna, it is preferable that the current flows in an orthogonal direction to generate excitation with a phase difference of 90 degrees. In the antenna device 2, as described below, two orthogonal excitation modes with a phase difference of 90 degrees are generated in the patch metal plate 2*a*, thereby enabling the reception of the circularly polarized waves.

As shown in FIG. 4B, the antenna device 2 uses a pin feed system which feeds power from the power feed body 5 at one power feed point 5*a*. This system can generate an excitation mode without using a special circuit element or the like in a power feed system, and is so simple as to easily receive the circularly polarized waves. To this end, the antenna device 2 has the cut portions 6 in the patch metal plate 2*a* so as to reliably receive the circularly polarized waves. In this case, the cut portions 6 are respectively provided at the places of the patch metal plate 2*a* corresponding to the positions of 3 o'clock and 9 o'clock of the time display portion 4, and the power feed point 5*a* is provided at a position in a 10 o'clock direction from the center of the patch metal plate 2*a*.

In the antenna device 2 having the above-described arrangement, if high-frequency power is fed from the power feed unit 70 (FIG. 4A) to the power feed body 5, a current flows from the 9 o'clock direction to the 3 o'clock direction between the two cut portions 6 of the patch metal plate 2*a* to generate an excitation mode F1, and in a direction orthogonal to the excitation mode F1, a current also flows from the 12 o'clock direction to the 6 o'clock direction to generate an excitation mode F2. Conversely, with the configuration of the antenna device 2, it is possible to set the power feed point 5*a* such that the above-described excitation modes F1 and F2 are generated. At this time, the length in which the excitation mode F1 and the excitation mode F2 are excited differs depending on the presence/absence of the cut portions 6, and with the adjustment of the cut length of the cut portions 6, control can be easily performed such that the excitation mode F1 has a phase different from the excitation mode F2, or the like.

That is, the antenna device 2 can control the two excitation modes F1 and F2 which are generated in the patch metal plate 2*a* by adjusting the shape of the cut portions 6 in the patch metal plate 2*a* and the relative positions of the power feed point 5*a* and the cut portions 6. If the excitation mode F1 and the excitation mode F2 are out of phase by 90 degrees, it is possible to effectively receive the circularly polarized waves.

Figure 5:
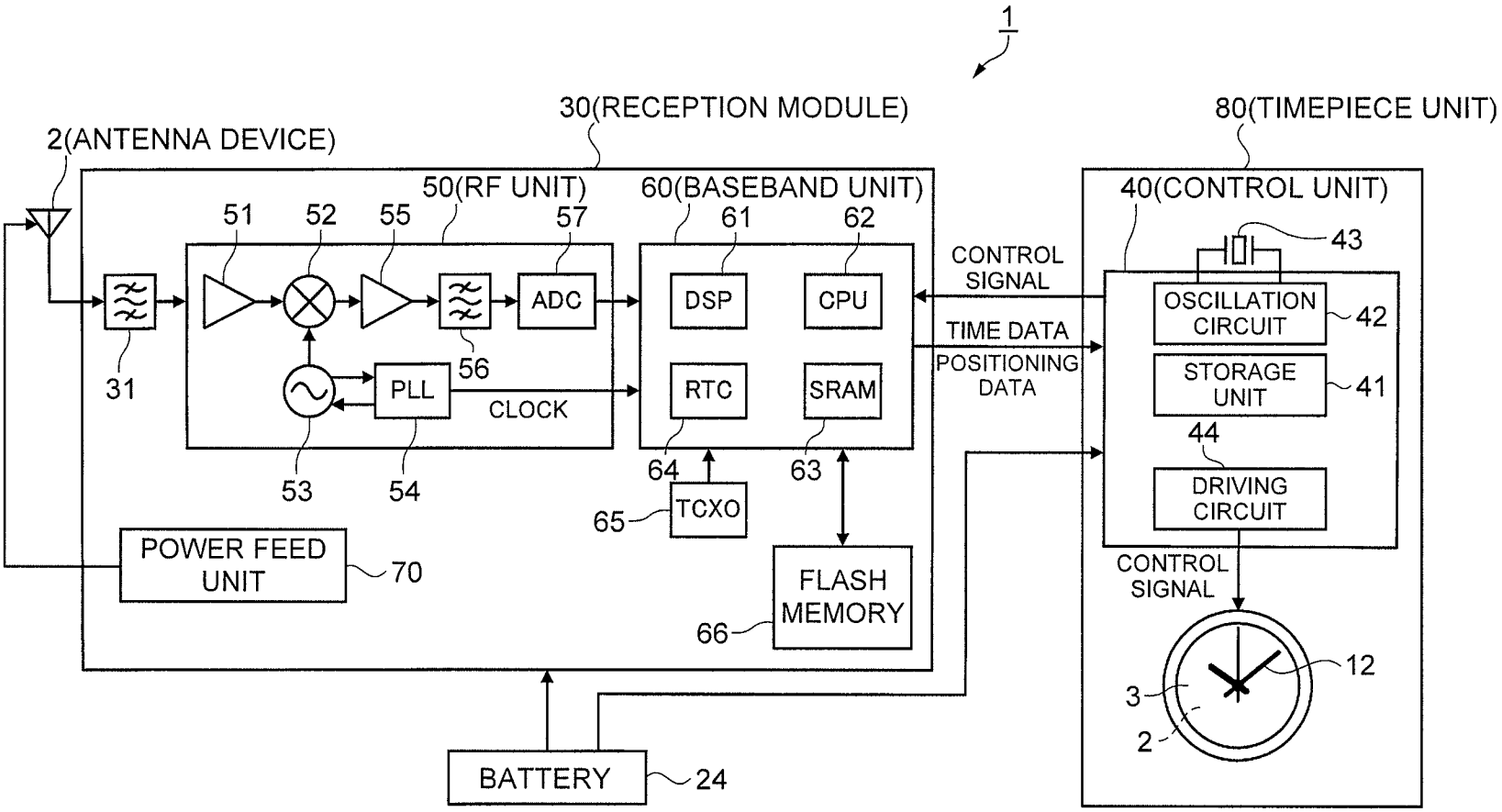
FIG. 5 is a block diagram showing the circuit configuration of a wristwatch having a GPS reception function.

Next, the circuit configuration of the wristwatch 1 having a GPS reception function will be described. FIG. 5 is a block diagram showing the circuit configuration of a wristwatch having a GPS reception function. The wristwatch 1 includes a time measurement mode in which a satellite signal is received from at least one GPS satellite 90 and internal time information is corrected on the basis of GPS time information, and a positioning mode in which satellite signals are received from a plurality of GPS satellites 90, positioning calculation is performed to obtain a current location, and time different information is corrected on the basis of the time difference and GPS time information specified from the current location. The wristwatch 1 includes an antenna device 2, a reception module 30, a timepiece unit 80 including a control unit 40, and a battery 24.

The reception module 30 has the antenna device 2 connected thereto and includes an SAW (Surface Acoustic Wave) filter 31, an RF (Radio Frequency) unit 50, and a baseband unit 60. The SAW filter 31 performs a process for extracting a satellite signal from a signal received by the antenna device 2. The RF unit 50 includes an LNA (Low Noise Amplifier) 51, a mixer mixer 52, a VCO (Voltage Controlled Oscillator) 53, a PLL (Phase Locked Loop) circuit 54, an IF (Intermediate Frequency) amplifier 55, an IF filter 56, and an ADC (A/D converter) 57.

A satellite signal extracted by the SAW filter 31 is amplified by the LNA 51, is mixed with a clock signal output from the VCO 53 by the mixer 52, and is down-converted to a signal in an intermediate frequency band. The PLL circuit 54 compares the phases of a clock signal and a reference clock signal divided from the output clock signal of the VCO 53 and synchronizes the output clock signal of the VCO 53 with the reference clock signal. The signal mixed by the mixer 52 is amplified by the IF amplifier 55, and a high-frequency signal is removed by the IF filter 56. The signal having passed through the IF filter 56 is converted to a digital signal by the ADC (A/D converter) 57. The baseband unit 60 includes a DSP (Digital Signal Processor) 61, a CPU (Central Processing Unit) 62, an SRAM (Static Random Access Memory) 63, and an RTC (Real Time Clock) 64. A temperature compensation circuit-equipped crystal oscillation circuit (TCXO: Temperature Compensated Crystal Oscillator) 65, a flash memory 66, and the like are connected to the baseband unit 60.

The temperature compensation circuit-equipped crystal oscillation circuit (TCXO) 65 generates the reference clock signal having a substantially constant frequency regardless of temperature. The flash memory 66 stores time difference information. The time difference information is information in which the time difference of each of a plurality of regions with segmentalized geographical information is defined. If the time measurement mode or the positioning mode is set, the baseband unit 60 performs a process for demodulating a baseband signal from the digital signal converted by the ADC 57 of the RF unit 50. The baseband unit 60 acquires satellite information, such as orbit information or GPS time information, in a navigation message of the trapped GPS satellite 90, and stores the satellite information in the SRAM 63.

The timepiece unit 80 includes the control unit 40 and a crystal vibrator 43. The control unit 40 includes a storage unit 41, an oscillation circuit 42, and a driving circuit 44, and performs various kinds of control. The control unit 40 controls the reception module 30 and sends a control signal to the reception module 30. The control unit 40 controls the reception operation of the reception module 30 and also controls the driving of the indicator 12 through the driving circuit 44 of the control unit 40. The storage unit 41 stores internal time information, and the internal time information is information regarding the time measured in the wristwatch 1. The internal time information is updated by the reference clock signal generated by the crystal vibrator 43 and the oscillation circuit 42. Accordingly, even when power supply to the reception module 30 is stopped, the internal time information can be updated and the driving of the indicator 12 can be continued.

If the time measurement mode is set, the control unit 40 controls the operation of the reception module 30, corrects the advance or delay of the internal time information on the basis of the GPS time information, and stores the internal time information in the storage unit 41. If the positioning mode is set, the control unit 40 controls the operation of the reception module 30, corrects the internal time information on the basis of the GPS time information and the time difference information obtained from the current location, and stores the internal time information in the storage unit 41. Accordingly, the wristwatch 1 recognizes the advance or delay of the time being displayed, thereby correcting time measurement by the crystal vibrator 43 with high precision and constantly displaying the accurate time. The wristwatch 1 recognizes the time difference information, such that, even during movement between regions with a time difference, or the like, it is possible to constantly display the time of the current location accurately.

The major effects of the antenna device 2 and the wristwatch 1 in the above-described embodiment will be described.

(1) In the antenna device 2 of the wristwatch 1, the patch metal plate 2*a* constitutes a part of the character plate 3 of the wristwatch 1. Accordingly, it becomes possible to substantially minimize the occupying region of the antenna device 2 in the wristwatch 1, in particular, from the viewpoint of thickness. Since the patch metal plate 2*a* receives electric waves, it is not necessary to take into consideration the use of an insulating member or the like such that electric waves pass through the character plate 3, and it is not necessary to add electrical control such that the phase of a reception signal of electric waves is changed. As described above, the antenna device 2 can achieve a function of receiving electric waves without being subjected to the restriction of design of the wristwatch 1, or the like.

(2) In the wristwatch 1, the patch metal plate 2*a* from among the two electrodes of the antenna device 2 functions as a part of the character plate 3, and the movement electrode portion 2*c* functions as a part of the movement 13. That is, in the wristwatch 1, timepiece components are used as both electrodes, such that, even when the antenna device 2 is embedded therein, it is possible to further suppress an increase in size, in particular, an increase in thickness.

Embodiment 2

Next, another embodiment of an antenna device will be described. In this case, an antenna device is mounted in a digital wristwatch (electronic timepiece), and a wristwatch includes a reflective liquid crystal display unit.

Figure 6:
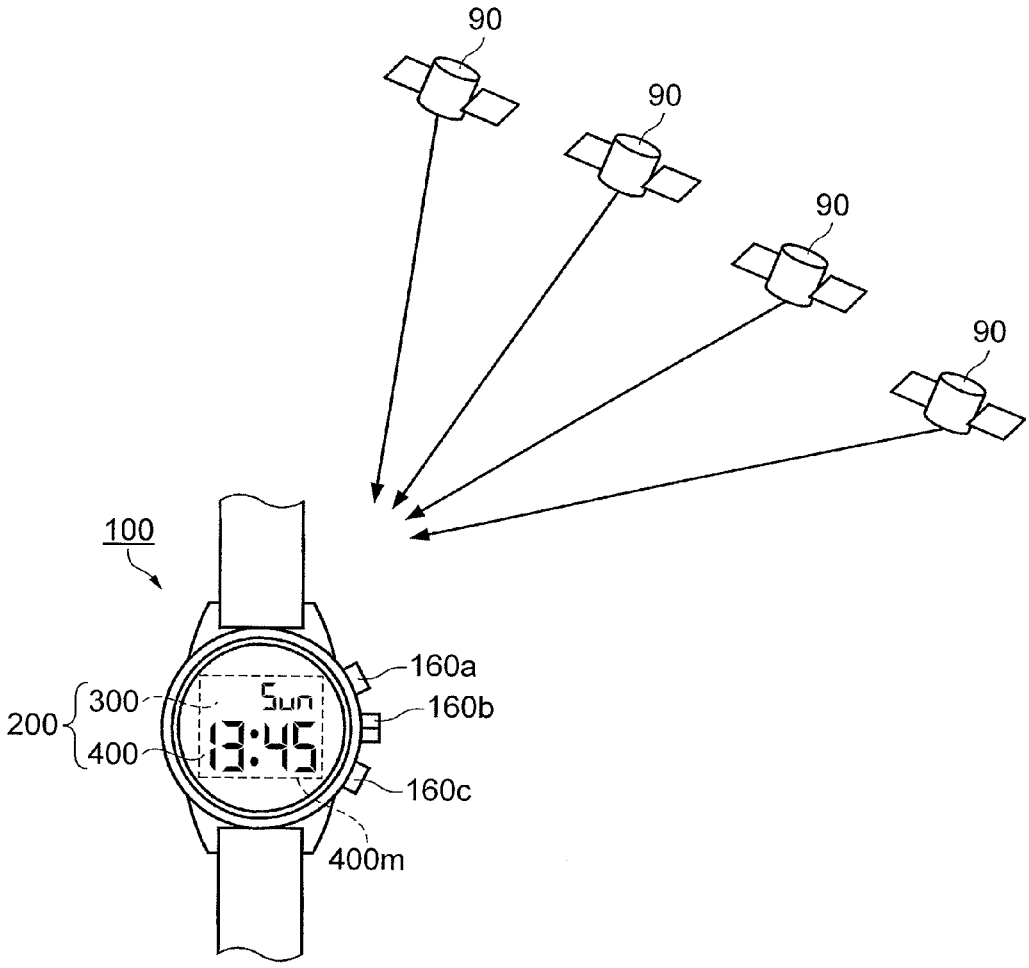
FIG. 6 is a schematic view showing the outline of a GPS system in Embodiment 2.

FIG. 6 is a schematic view showing the outline of a GPS system in Embodiment 2. As shown in FIG. 6, GPS satellites (satellites) 90 travel in a predetermined orbit above the earth, and transmit satellite signals to the ground. Each satellite signal includes GPS time information which is very accurate time information measured by an atomic timepiece. For this reason, a digital wristwatch (electronic timepiece) 100 having a function as a GPS receiver receives satellite signals to correct the advance or delay of the internal time, thereby displaying the accurate time. This correction is done as a time measurement mode.

The satellite signals also include orbit information which represents the position of the GPS satellite 90 in an orbit, or the like. The wristwatch 100 has a function of performing positioning calculation using the orbit information or the like, can easily correct the time difference in accordance with the current position. This correction is done as a positioning mode. If the satellite signals are used, various applications for current position display, moving distance measurement, moving speed measurement, and the like can be made. In the wristwatch 100, these kinds of information can be displayed in a digital manner by a reflective liquid crystal display unit 400 corresponding to the character plate 3 of the analog wristwatch 1.

Figure 7A:
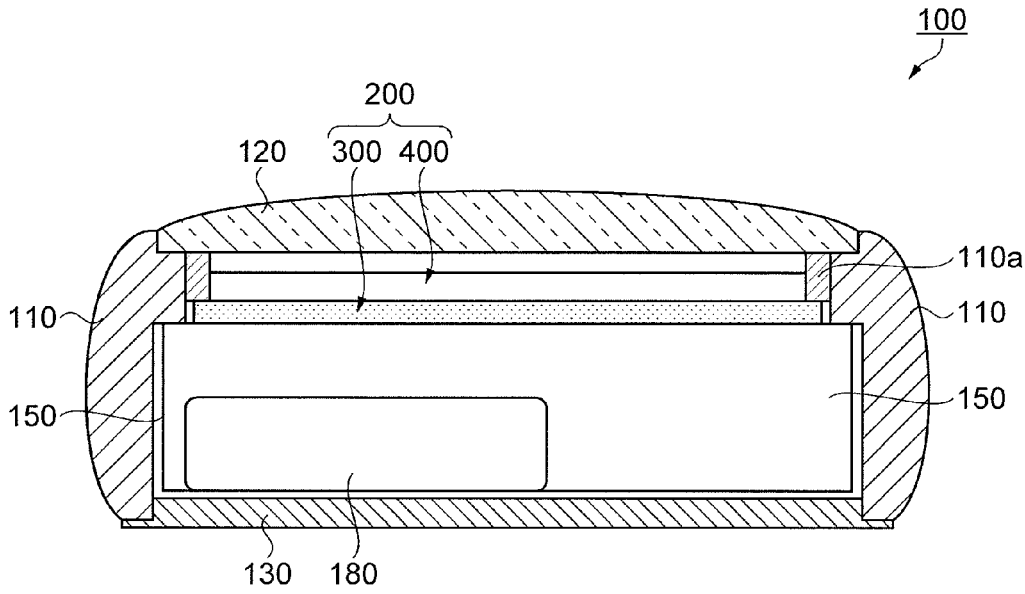
FIG. 7A is a sectional view showing the configuration of a digital wristwatch having a GPS reception function in Embodiment 2.
Figure 7B:
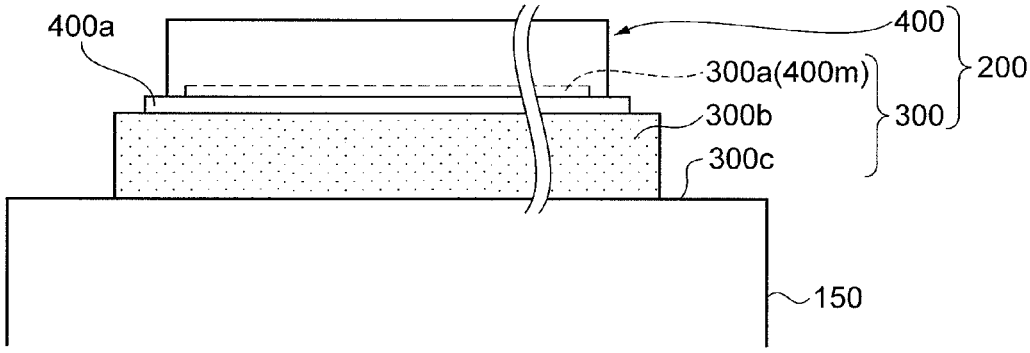
FIG. 7B is a sectional view showing the configuration of an antenna device.

An example of the configuration of the wristwatch 100 having a GPS reception function will be described. FIG. 7A is a sectional view showing the configuration of a digital wristwatch having a GPS reception function in Embodiment 2, and FIG. 7B is a sectional view showing the configuration of an antenna device. As shown in FIGS. 7A and 6, the GPS reception function-equipped wristwatch 100 includes an exterior case 110 which is made of metal, such as stainless steel or titanium, or resin, such as plastic. In this case, the exterior case 110 is formed in a substantially cylindrical shape, and has a glass 120 which is attached to an opening on the front side, that is, the side on which information, such as time, is visually recognized, a rear cover 130 which is attached to an opening on the rear side, and buttons 160*a*, 160*b*, 160*c* (FIG. 6) which are provided on the lateral side of the exterior case 110. The buttons 160 are manually operated and are configured such that display on the reflective liquid crystal display unit 400 can be set, or the like.

Inside the exterior case 110 are provided a module 150 which has a driving mechanism for ticking or the like, or a processing mechanism for processing and displaying information, and substantially has a cylindrical shape with the metallic front side, an antenna device 200 which is arranged on the front side of the module 150, a battery 180 which is embedded in the module 150, and the like. The antenna device 200 has an antenna unit 300 which receives satellite signals from the GPS satellites 90, and a reflective liquid crystal display unit 400 which is arranged on the front side of the antenna unit 300 and displays information, such as time. In this wristwatch 100, the antenna unit 300 and the reflective liquid crystal display unit 400 of the antenna device 200 have a rectangular shape, and the outer circumference thereof is accommodated in the inner circumference of a ring 110*a* having a substantially circular shape.

In regard to the detailed configuration of the antenna unit 300 of the antenna device 200, in this case, as shown in FIG. 7B, a module electrode portion (second electrode) 300*c* which is a surface on the front side of the module 150, a dielectric layer 300*b*, and a patch metal plate 300*a* which is provided in the reflective liquid crystal display unit 400 are provided in order from the front side of the module 150. That is, the patch metal plate 300*a* and the module electrode portion (second electrode) 300*c* are positioned to face each other through the dielectric layer 300*b*.

Figure 8A:
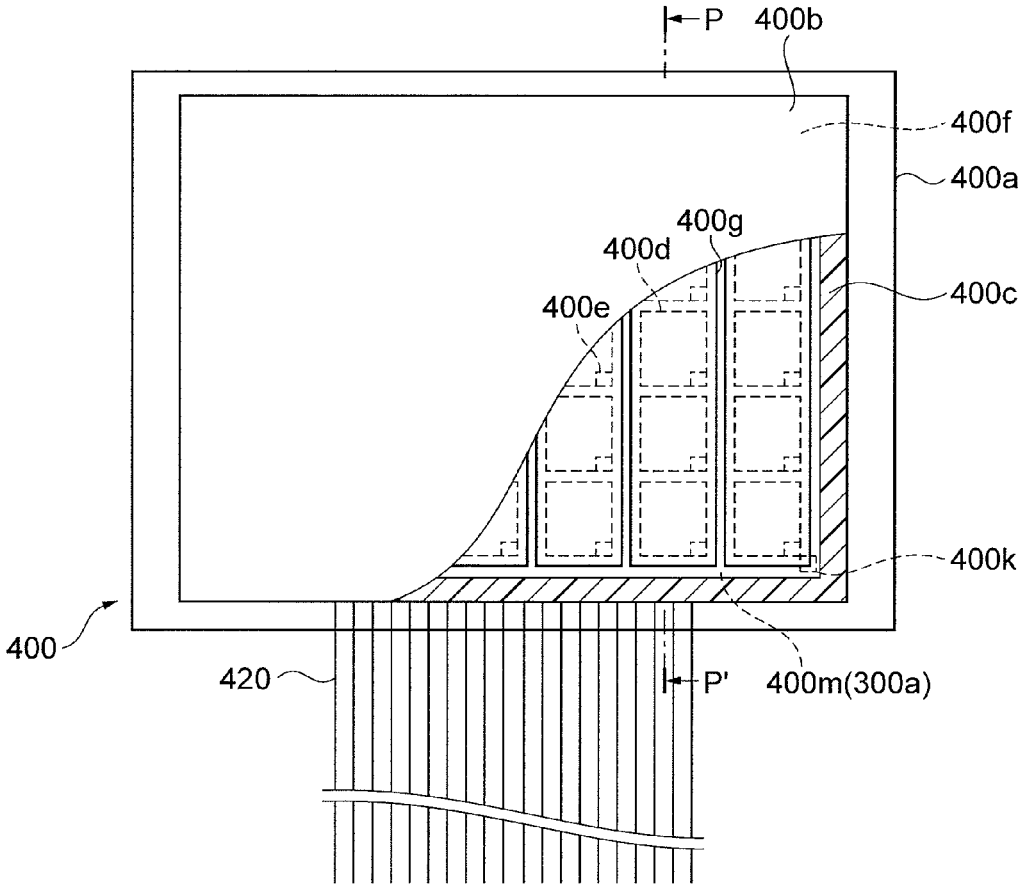
FIG. 8A is a plan view showing the configuration of a liquid crystal display unit.
Figure 8B:
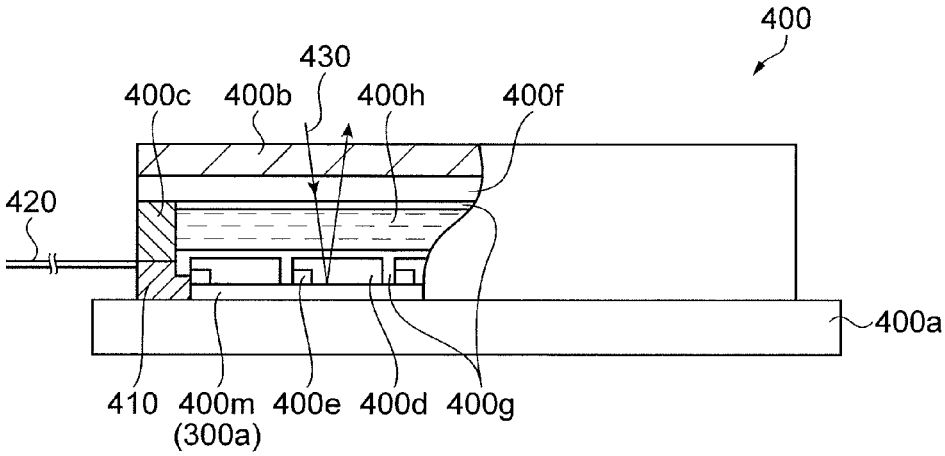
FIG. 8B is a sectional view showing the configuration of a liquid crystal display unit.

Next, the reflective liquid crystal display unit 400 will be described. FIG. 8A is a plan view showing the configuration of a liquid crystal display unit, and FIG. 8B is a sectional view showing the configuration of a liquid crystal display unit. FIG. 8B is a sectional view taken along the line P-P' of FIG. 8A. In FIGS. 8A and 8B, the reflective liquid crystal display unit 400 is configured such that a TFT (Thin Film Transistor) substrate 400*a* as a base, on which the reflective liquid crystal display unit 400 is formed, and a counter substrate 400*b* which is paired with the TFT substrate 400*a* are bonded together by a sealing material 400*c* as a sealant. The sealing material 400*c* forms a closed frame-like region within the surfaces of both substrates.

The reflective liquid crystal display unit 400 is provided inside the frame-like region defined by the sealing material 400*c* in the TFT substrate 400*a*. The reflective liquid crystal display unit 400 has a light reflective plate (light reflective portion) 400*m* which also functions as the above-described patch metal plate 300*a*, a plurality of pixel electrodes 400*d* which are arranged on the surface of the light reflective plate 400*m* in a mosaic, TFTs (Thin Film Transistors) 400*e* which perform switching control of the respective pixel electrodes 400*d*, a planar counter electrode 400*f* which is arranged to face the pixel electrodes 400*d* on the surface of the counter substrate 400*b* on the TFT substrate 400*a* side, an alignment film 400*g* which is formed to cover the pixel electrodes 400*d* and the counter electrode 400*f*, and liquid crystal 400*h* which is filled in the region defined by the sealing material 400*c* and the alignment film 400*g*. The pixel electrodes 400*d*, the TFTs 400*e*, the counter electrode 400*f*, and the alignment film 400*g* are formed of transparent members. The liquid crystal 400*h* transmits or blocks light 430 to correspond to the pixel electrodes 400*d* subjected to switching control by the TFTs 400*e* to display various kinds of information. At this time, the light reflective plate 400*m* reflects light 430 which is input from the counter substrate 400*b* side and transmits the liquid crystal 400*h*. Light 430 reflected by the light reflective plate 400*m* passes through the liquid crystal 400*h* again and is emitted from the counter substrate 400*b*. Accordingly, information displayed by the liquid crystal 400*h* can be visually recognized from the glass 120 side. The reflective liquid crystal display unit 400 has a flexible wire 420 for connection to the outside through a terminal portion 410.

The reflective liquid crystal display unit 400 has a feature in that the light reflective plate 400*m* also has a function as a patch electrode plate (first electrode) 300*a* of the antenna unit 300. In the vicinity of the sealing material 400*c*, a power feed body 400*k* is provided to feed high-frequency power to the light reflective plate 400*m* which functions as a first electrode. The function of receiving satellite signals by the light reflective plate 400*m* and the power feed body 400*k* will be described below with reference to FIGS. 10A and 10B.

Figure 9:
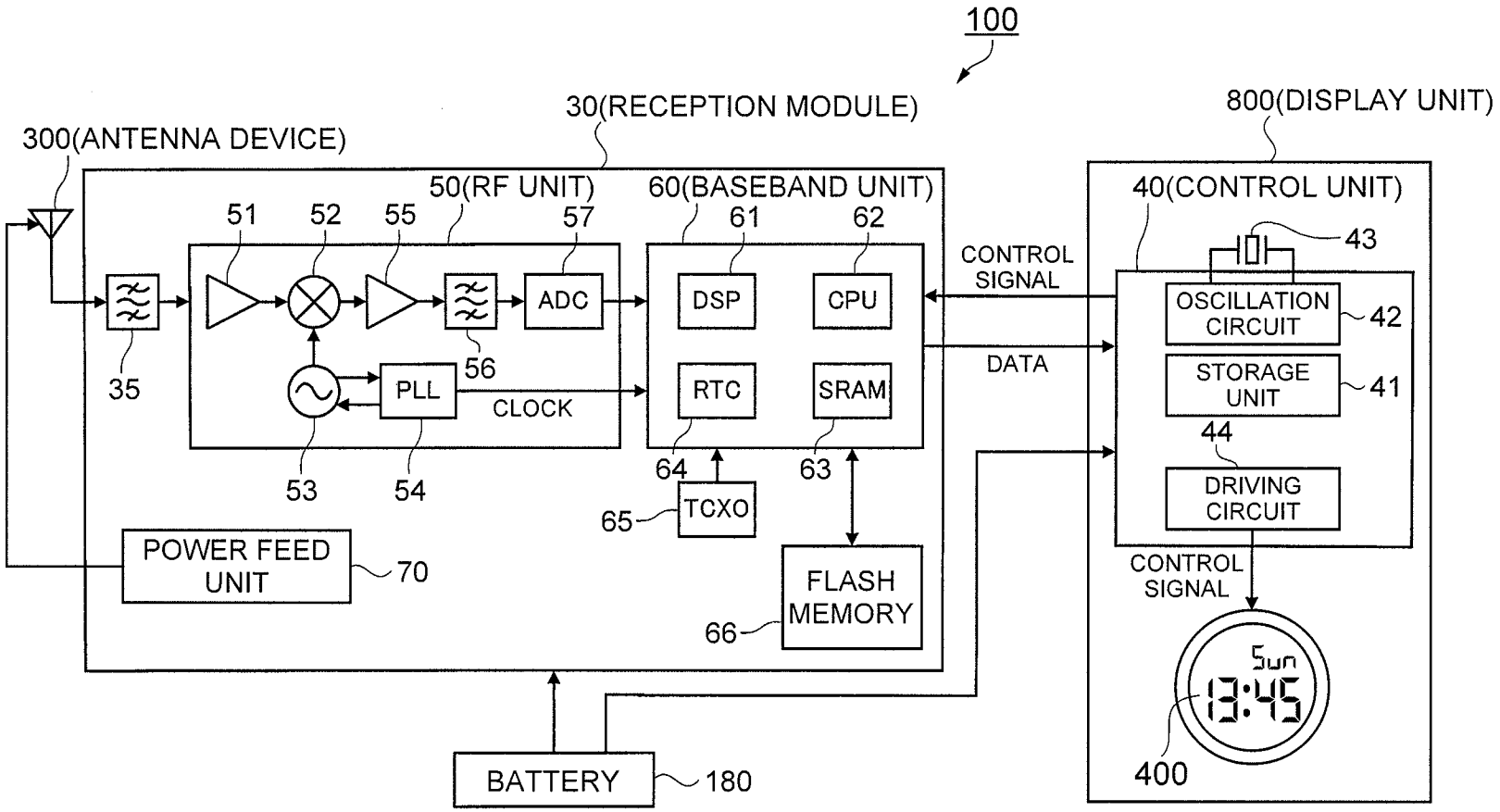
FIG. 9 is a block diagram showing the circuit configuration of a wristwatch having a GPS reception function.

Next, the circuit configuration of the wristwatch 100 having a GPS reception function will be described. FIG. 9 is a block diagram showing the circuit configuration of a wristwatch having a GPS reception function. The digital wristwatch 100 includes an antenna unit 300, a reception module 30, a display unit 800 including a control unit 40, and a battery 180. The circuit constituent components of the wristwatch 100 substantially have the same functions as the antenna device 2, the reception module 30, the timepiece unit 80 including the control unit 40, and the battery 24 in the analog wristwatch 1, thus detailed description thereof will not be repeated.

The antenna device 200 which is embedded in the wristwatch 100 needs to receive satellite signals from a plurality of GPS satellites 90 (FIG. 6). Since the electric waves of the satellite signals transmitted from the GPS satellites 90 are so-called circularly polarized waves, it is preferable that the antenna device 200 is a patch antenna which is suitable for receiving the circularly polarized waves, and has a compact shape so as to be incorporated in the wristwatch 100. Accordingly, in the antenna device 200, the antenna unit 300 and the reflective liquid crystal display unit 400 of the wristwatch 100 are combined together as a single body.

Figure 10A:
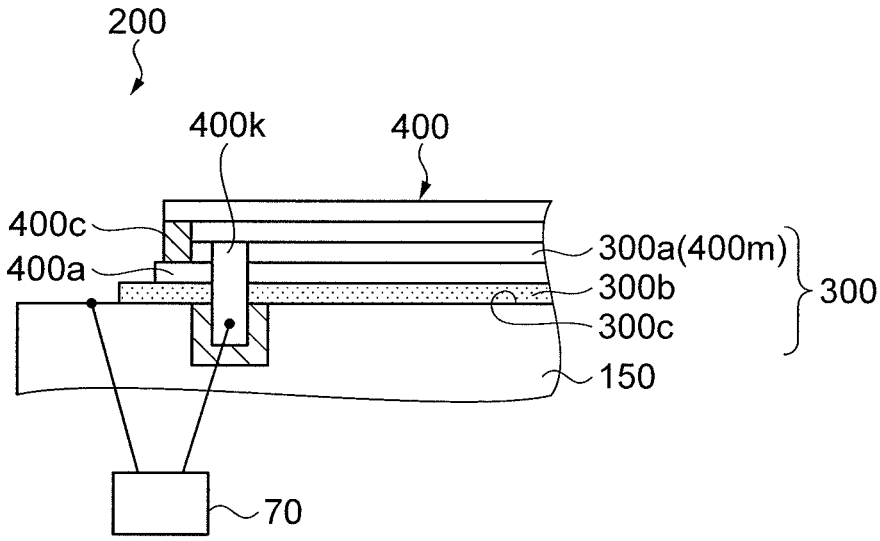
FIG. 10A is a sectional view showing a power feed configuration of an antenna device.
Figure 10B:
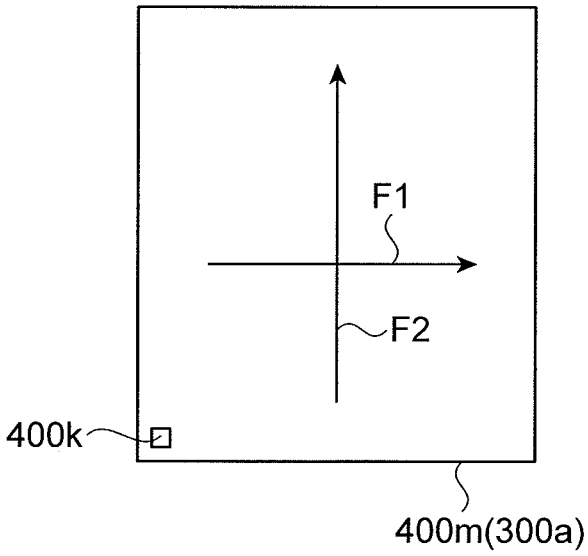
FIG. 10B is a plan view showing an excitation mode in a light reflective plate (first electrode).

FIG. 10A is a sectional view showing a power feed configuration to an antenna device, and FIG. 10B is a plan view showing an excitation mode in a light reflective plate (first electrode). As shown in FIGS. 10A and 10B, the antenna device 200 has a patch metal plate 300*a* which also functions as a first electrode of a patch antenna, that is, the above-described light reflective plate 400*m*, a module electrode portion 300*c* which functions as a second electrode, that is, a receiving surface of the antenna device 200 in the module 150, and a dielectric layer 300*b* which is arranged between the patch metal plate 300*a* and the module electrode portion 300*c*.

Usually, the patch metal plate 300*a* functions if being made of a conductor, such as copper, aluminum, iron, gold, silver, or palladium, or an alloy thereof. In this case, since the patch metal plate 300*a* is also used as the light reflective plate 400*m*, the patch metal plate 300*a* is formed of aluminum with the mirror-finished surface. That is, the patch metal plate 300*a* constitutes the antenna unit 300 and also constitutes the reflective liquid crystal display unit 400.

The dielectric layer 300*b* has a rectangular shape of the substantially same size as the patch metal plate 300*a*. The dielectric layer 300*b* is formed of magnesia titanate ($MgTiCO_3$) in a rectangular shape of vertical 2 cm and horizontal 3 cm having a thickness of 0.5 mm, and has the characteristics such that a dielectric constant is 17 and a dielectric tangent is 0.001. Examples of the usable material for the dielectric layer 300*b* include alumina ($Al_2O_3$), mullite ($3Al_2O_3.2SiO_2$) steatite ($MgO/SiO_2$), forsterite ($2Mg_2O/SiO_2$), zirconia (PSZ), and the like.

In the antenna device 200 having the above-described configuration, the power feed body 400*k* is provided to feed power from the power feed unit 70 (FIG. 9) to the patch metal plate 300*a*. The power feed body 400*k* is a metallic electrical conductor which is provided at a predetermined position with respect to the patch metal plate 300*a*. The power feed body 400*k* is mounted in the module 150 such that the power feed body 400*k* is inserted into the TFT substrate 400*a* and the dielectric layer 300*b* in a state of being connected to the patch metal plate 300*a*, and the inserted tip is not in contact with the module 150 through an insulator. Accordingly, power is fed from the power feed unit 70 to the patch metal plate 300*a* through the power feed body 400*k*, and power is also fed from the power feed unit 70 to the module electrode portion 300*c*. In this case, the module electrode portion 300*c* is on the ground side and functions as a so-called ground electrode. A wire for power feed to the power feed body 400*k* also functions as a wire for reception of the patch metal plate 300*a*.

Next, the reception of electric waves, that is, positioning signals from the GPS satellites 90 by the antenna unit 300 will be described. In regard to the electric waves from the GPS satellites 90, circularly polarized waves are used such that, even when a receiving object, such as a mobile object, is in an arbitrary direction, the receiving object can receive the electric waves. In order to receive the circularly polarized waves, it is important to rotate a current flowing in the antenna over time. To this end, in the patch metal plate 300*a*, it is preferable that a current flows in an orthogonal direction to generate excitation with a phase difference of 90 degrees. In the antenna unit 300, as described below, two orthogonal excitation modes with a phase difference of 90 degrees are generated in the patch metal plate 300*a*, thereby enabling the reception of the circularly polarized waves.

As shown in FIG. 10B, the antenna unit 300 of the antenna device 200 uses a pin feed system which feeds power in a portion of the power feed body 400*k*. This system can generate an excitation mode without using a special circuit element in a power feed system, and is so simple as to easily receive the circularly polarized waves. In the antenna unit 300 having the above-described arrangement, if high-frequency power is fed from the power feed unit 70 to the power feed body 400*k*, a current flows in the patch metal plate 300*a* in a short side direction to generate an excitation mode F1, and in a direction orthogonal to the excitation mode F1, a current flows in a long side direction to generate an excitation mode F2. Conversely, with the configuration of the antenna device 200, the power feed body 400*k* can be set such that the above-described excitation modes F1 and F2 are generated. At this time, the length in which the excitation mode F1 and the excitation mode F2 are excited differs depending on the rectangular shape of the patch metal plate 300*a*, and with the adjustment of the length of each of the short side and the long side, control can be easily performed such that the excitation mode F1 has a phase different from the excitation mode F2, or the like. When the patch metal plate 300*a* substantially has a circular shape, not a rectangular shape, in addition to the setting of the position of the power feed body 400*k*, it is preferable to provide cut portions in the patch metal plate 300*a* such that the excitation modes F1 and F2 are generated.

As described above, in the antenna device 200 of the wristwatch 100, the patch metal plate 300*a* (first electrode) of the antenna unit 300 is also used as the light reflective plate 400*m* of the reflective liquid crystal display unit 400. A part of the module 150 is also used as the module electrode portion 300*c* (second electrode). From these, in the antenna device 200, it is possible to reduce the number of constituent elements to be used. In the antenna device 200, it becomes possible to substantially minimize the occupying region inside the wristwatch 100, in particular, from the viewpoint of thickness, to reduce size without being subjected to the restriction of design of the wristwatch 100, or the like, and to achieve a function of receiving electric waves.

Embodiment 3

Next, another embodiment of antenna device will be described. In this case, an antenna device is mounted in a digital wristwatch (electronic timepiece), and a wristwatch includes a transmissive liquid crystal display unit having a light source.

Figure 11:
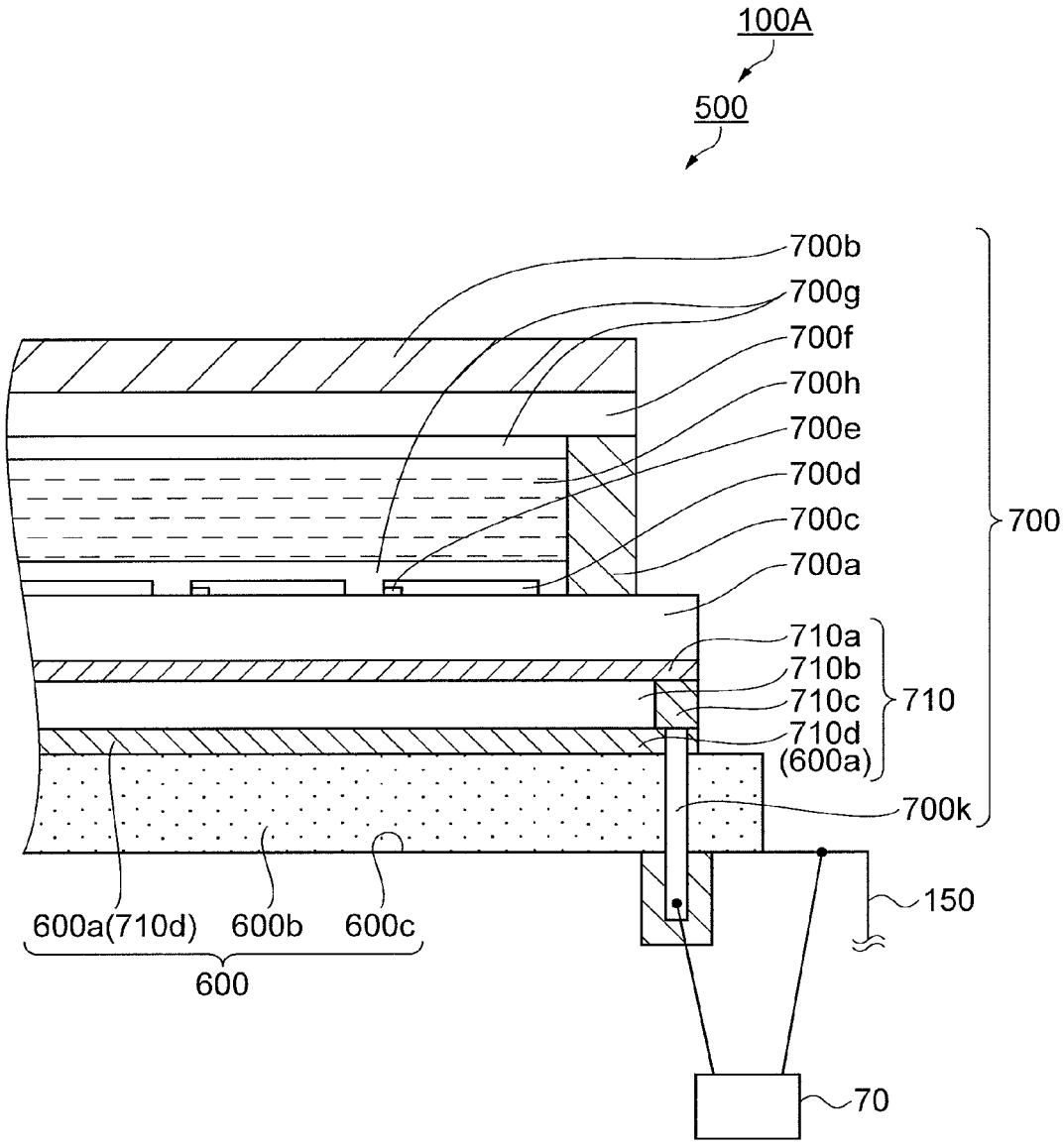
FIG. 11 is a sectional view showing an antenna device having an organic EL in Embodiment 3.

FIG. 11 is a sectional view showing an antenna device including an organic EL in Embodiment 3. As shown in FIG. 11, an antenna device 500 of a wristwatch 100A has an antenna unit 600, a transmissive liquid crystal display unit 700 which has an organic electroluminescence unit 710 (a light source, hereinafter, referred to as an organic EL unit) emitting white light, and a module 150 which has a driving mechanism for ticking or the like, or a processing mechanism for processing and displaying information.

The transmissive liquid crystal display unit 700 is configured such that a TFT (Thin Film Transistor) substrate 700*a* as a base, on which the transmissive liquid crystal display unit 700 is formed, and a counter substrate 700*b* which is paired with the TFT substrate 700*a* are bonded together by a sealing material 700*c* as a sealant. The sealing material 700*c* forms a closed frame-like region within the surfaces of both substrates.

The transmissive liquid crystal display unit 700 has a plurality of pixel electrodes 700*d* which are arranged on the surface of the TFT substrate 700*a* in a mosaic, TFTs 700*e* which perform switching control of the respective pixel electrodes 700*d*, a planar counter electrode 700*f* which is arranged on the surface of the counter substrate 700*b* on the TFT substrate 700*a* side to face the pixel electrodes 700*d*, an alignment film 700*g* which is formed to cover the pixel electrodes 700*d* and the counter electrode 700*f*, and liquid crystal 700*h* which is filled in the region defined by the sealing material 700*c* and the alignment film 700*g*. The pixel electrodes 700*d*, the TFTs 700*e*, the counter electrode 700*f*, and the alignment film 700*g* are formed of transparent members. The liquid crystal 700*h* displays various kinds of information corresponding to the pixel electrodes 700*d* subjected to switching control by the TFTs 700*e*.

The transmissive liquid crystal display unit 700 has the organic EL unit 710 on the surface of the TFT substrate 700*a* opposite to the pixel electrodes 700*d*. The organic EL unit 710 has, from the TFT substrate 700*a* side, a front electrode 710*a*, a rear electrode (light source electrode) 710*d* which is arranged in pairs with the front electrode 710*a*, a seal portion 710*c* which is provided on the outer circumferential portions of the front electrode 710*a* and the rear electrode 710*d* and bond both electrodes together, and a light-emitting material layer 710*b* which is formed in a region defined by the front electrode 710*a*, the rear electrode 710*d*, and the seal portion 710*c*. The light-emitting material layer 710*b* has a hole transport layer (not shown) which is formed on the rear electrode 710*d*, and a light-emitting layer (not shown) which is formed on the hole transport layer and emits white light. The light emission of the light-emitting layer is controlled by the rear electrode 710*d* electrically connected to a switching element (not shown). White light emitted from the organic EL unit 710 passes through the TFT substrate 700*a* and the liquid crystal 700*h*, and is emitted from the counter substrate 700*b*. Accordingly, in the wristwatch 100A, information displayed by the liquid crystal 700*h* is visually recognized. In this case, since the rear electrode 710*d* also functions as the patch metal plate 600*a*, that is, the first electrode of the antenna unit 600, the transmissive liquid crystal display unit 700 has a power feed body 700*k* for feeding high-frequency power to the rear electrode 710*d*.

Next, the antenna unit 600 has the patch metal plate 600*a* which is the rear electrode 710*d* of the organic EL unit 710 and also functions as the first electrode, a module electrode portion 600*c* which is a receiving surface of the antenna device 500 in the module 150 and also functions as the second electrode, and a dielectric layer 600*b* which is arranged between the patch metal plate 600*a* and the module electrode portion 600*c*. The reception of the positioning signals from the GPS satellites 90 by the antenna unit 600 is done in the same manner as in the antenna device 200 of Embodiment 2. That is, the reception is done in a way such that the light reflective plate 400*m* (patch metal plate 300*a*) as the first electrode of the antenna device 200 in FIG. 10B is substituted with the rear electrode 710*d* (patch metal plate 600*a*) as the first electrode of the antenna device 500.

As described above, in the antenna device 500 of the wristwatch 100A, the rear electrode 710*d* of the organic EL unit 710 of the transmissive liquid crystal display unit 700 is also used as the patch metal plate 600*a* (first electrode) of the antenna unit 600. A part of the module 150 is also used as the module electrode portion 600*c* (second electrode). From these, in the antenna device 500, it is possible to reduce the number of constituent elements to be used, to achieve a reduction in thickness and size without being subjected to the restriction of design of the wristwatch 100A, or the like, and to achieve a function of receiving electric waves.

The antenna devices 2, 200, 500 and the wristwatches 1, 100, and 100A are not limited to the foregoing embodiments, and even in the following modifications, the same effects as in the embodiments are obtained. First, modifications (A1 to A7) to the analog wristwatch 1 including the antenna device 2 in Embodiment 1 will be described.

Modification A1

Although the patch metal plate 2*a* and the dielectric layer 2*b* of the antenna device 2 have a circular shape of the same size, the invention is not limited thereto. The patch metal plate 2*a* and the dielectric layer 2*b* may have circular shapes of different size or may have a rectangular shape. For example, even when the patch metal plate 2*a* is smaller than the dielectric layer 2*b* having a diameter of 3 cm by 4 mm, it is found that the substantially same reception performance can be maintained.

Modification A2

The second electrode of the antenna device 2 may be separately provided between the movement 13 and the dielectric layer 2*b*, not the movement electrode portion 2*c* which constitutes a part of the movement 13. Although the thickness increases compared to the configuration of the antenna device 2, the same satellite signal reception performance is obtained.

Modification A3

The shape of the cut portions 6 of the patch metal plate 2*a* is not limited to the shape which is formed to be concave from the outer circumference toward the circle center, a shape which protrudes to be convex from the outer circumference may be used. The cut portions 6 may not have a rectangular shape. The cut portions 6 may have a shape in which the outer circumference is cut in a chamfered shape. Therefore, the patch metal plate 2*a* can do flexible setting corresponding to the design shape of the character plate 3, or the like.

Modification A4

Although the patch metal plate 2*a* has the time display portion 4 formed on the front side, the patch metal plate 2*a* itself may be the time display portion 4. In the specification in which the character plate 3 made of an alloy of gold, silver, or the like is used, it is preferable in that expensive-looking of a pure material is created.

Modification A5

The patch metal plate 2*a* may have a mesh shape or a shape with a through hole. With this, the antenna device 2 can achieve saving in materials and a reduction in weight without damaging the characteristics.

Modification A6

Although the antenna device 2 is configured such that power is fed from the power feed body 5 at a single place to the patch metal plate 2*a*, a configuration may be made such that power is fed from many places. While control or the like is complicated compared to the antenna device 2, the satellite signals can be received.

Modification A7

Although the wristwatch 1 has a function of receiving the positioning signals from the GPS satellite 90 and correcting the time and the time difference, in addition, the wristwatch 1 may also have a function of displaying the current position, the moving distance, the moving speed, or the like. An electronic timepiece is not limited to the wristwatch 1, a travel clock, a pocket watch may be used, or watches attached to portable electronic apparatuses may be used.

Next, modifications (D1 to D4) to the antenna devices 200 and 500 and the digital wristwatches 100 and 100A in Embodiments 2 and 3 will be described.

Modification D1

Although the exterior case 110 of the wristwatch 100 or 100A substantially has a cylindrical shape in plan view with the opening on the front side, the invention is not limited thereto. The exterior case may have a rectangular shape, such as an oblong shape. The antenna device 200 or 500 is not limited to a rectangular shape, and may have other shapes, such as a circular shape. Even when the antenna device 200 or 500 is a so-called inverse F antenna which has the same electrode configuration, it is possible to sufficiently exhibit an antenna function.

Modification D2

Although the antenna device 200 or 500 performs monochrome display using the liquid crystal 400*h* or 700*h*, a configuration may be made such that color filters are used to perform color display.

Modification D3

Although the wristwatch 100 or 100A has a function of receiving the positioning signals from the GPS satellites 90 and correcting the time and the time difference, in addition, the wristwatch 100 or 100A may also have a function of displaying information, such as the current position, the moving distance, or the moving speed. With the display in a digital manner, it is possible to accurately express information or the like with sophisticated numerals.

Modification D4

In addition to the reflective liquid crystal display unit 400 and the transmissive liquid crystal display unit 700 in the wristwatches 100 and 100A, an EPD (Electro Phoretic Display) corresponds to a character plate. The EPD has, for example, a configuration in which microcapsules filled with a liquid having white and black particulates are covered on a thin film, the white particulates are positively charged, and the black particulates are negatively charged. If a negative electric field is applied to the microcapsules, the white particulates are moved to the upper part of the microcapsules, and the black particulates are moved to the lower part of the microcapsules. For this reason, the black particulates hide in the white particulates and are not viewed from the upper side, and the surfaces (upper side) of the microcapsules are viewed white. If a positive electric field is applied, the converse phenomenon occurs. In this way, in the EPD, white or black microcapsules are arranged, thereby performing information display. In the EPD, a display portion can be easily curved, and a flexible display unit can be formed in accordance with the shape of the wristwatch. In this case, an electrode or the like to which an electric field is applied may be used as a patch metal plate (first electrode).

Modification D5

Although the wristwatch 100A has the organic EL unit 710 as a light source, a configuration may be made in which a light source other than the organic EL unit 710 is used. For example, a light source which has a light source lamp and a light guide body guiding light from the light source lamp to the pixel electrodes 700*d* may be used. In this case, instead of a configuration in which the patch metal plate (first electrode) of the antenna device is also used as the rear electrode 710*d* of the organic EL unit 710, the patch metal plate is arranged between the light source and the dielectric layer of the antenna device. Alternatively, a configuration may be made in which a patch metal plate may be a transparent plate and arranged between the light source and the TFT substrate 700*a*.

What is claimed is:

1. An antenna device which is provided in an electronic timepiece, the antenna device comprising:

a first electrode;

a second electrode; and a dielectric layer arranged between the first electrode and the second electrode, wherein the first electrode, the second electrode and the dielectric layer are configured to function as a patch antenna or inverse F antenna, and wherein the first electrode constitutes at least a part of a character plate of the electronic timepiece.

2. The antenna device according to claim 1, wherein the character plate has the first electrode and a time display portion which is formed on the surface of the electrical conductor portion.

3. The antenna device according to claim 2, wherein the time display portion is an electrical nonconductor.

4. The antenna device according to claim 1, wherein the second electrode constitutes at least a part of a mechanical body of the electronic timepiece.

5. An antenna device which is provided in an electronic timepiece, the antenna device comprising:

an antenna unit which has a first electrode, a second electrode, and a dielectric layer arranged between the first electrode and the second electrode; and a reflective liquid crystal display unit which has a light reflective portion, and displays information, wherein the first electrode, the second electrode, and the dielectric layer are configured to function as a patch antenna or inverse F antenna, and wherein the first electrode constitutes at least a part of the light reflective portion of the reflective liquid crystal display unit.

6. An antenna device which is provided in an electronic timepiece, and receives positioning signals from satellites, the antenna device comprising:

an antenna unit which has a first electrode, a second electrode, and a dielectric layer arranged between the first electrode and the second electrode;

a transmissive liquid crystal display unit which has a liquid crystal panel portion for displaying information; and an organic electroluminescence unit which is a light source of the transmissive liquid crystal display unit, and has a light-emitting layer and a light source electrode for emitting light from the light-emitting layer, wherein the first electrode constitutes at least a part the light source electrode of the organic electroluminescence unit.

7. The antenna device according to claim 6, further wherein the first electrode, the second electrode, and the dielectric layer are configured to function as a patch antenna or inverse F antenna.

8. An electronic timepiece comprising:

an antenna device; and a case enclosing the antenna device, wherein the antenna device comprises:

a first electrode;

a second electrode; and a dielectric layer arranged between the first electrode and the second electrode, wherein the first electrode, the second electrode, and the dielectric layer are configured to function as a patch antenna or inverse F antenna and wherein the first electrode constitutes at least a part of a character plate of the electronic time piece;

wherein the case and the first electrode are overlapped when viewed from the viewing side of the time.

9. An electronic time piece comprising:

an antenna device; and case enclosing the antenna device, wherein the antenna device comprises:

an antenna unit which has a first electrode, a second electrode, and a dielectric layer arranged between the first electrode and the second electrode;

a reflective liquid crystal display unit which has a light reflective portion, and displays information wherein the first electrode, the second electrode, and the dielectric layer are configured to function as a patch antenna or inverse F antenna, and wherein the first electrode constitutes at least a part of the light reflective portion of the reflective liquid crystal display unit.

10. An electronic timepiece comprising:

an antenna device; and a case enclosing the antenna device, wherein the antenna device comprises:

an antenna unit which has a first electrode, a second electrode, and a dielectric layer arranged between the first electrode and the second electrode;

a transmissive liquid crystal display unit which has a liquid crystal panel portion for displaying information; and an organic electroluminescence unit which is a light source of the transmissive liquid crystal display unit, and has a light-emitting layer and a light source electrode for emitting light from the light-emitting layer, wherein the first electrode constitutes at least a part the light source electrode of the organic electroluminescence unit.

* * * * *